United States Patent [19]

Rohr

[11] 4,047,752

[45] Sept. 13, 1977

[54] DECK CHAIR

[76] Inventor: Eduard Rohr, im Birch, 5506 Magenwil, Switzerland

[21] Appl. No.: 681,147

[22] Filed: Apr. 28, 1976

[30] Foreign Application Priority Data

May 13, 1975 Switzerland ..... 6091/75

[51] Int. Cl.[2] ..... A47C 4/00

[52] U.S. Cl. ..... 297/19; 297/16; 297/441

[58] Field of Search ..... 297/16, 441, 29, 440, 297/19; 403/93

[56] References Cited

U.S. PATENT DOCUMENTS

| | | | |
|---|---|---|---|
| 1,060,924 | 5/1913 | Manning | 403/93 |
| 1,066,155 | 7/1913 | Sayer, Jr. | 403/93 X |
| 2,098,609 | 11/1937 | Bishop | 403/93 X |
| 2,564,915 | 8/1951 | Nelson | 297/441 X |
| 2,712,349 | 7/1955 | Le Voir | 297/441 |
| 3,096,963 | 7/1963 | Welsh | 297/19 X |
| 3,195,954 | 7/1965 | Moreno | 297/441 |
| 3,348,882 | 10/1967 | Chassaignac | 297/441 X |

FOREIGN PATENT DOCUMENTS

| | | | |
|---|---|---|---|
| 2,045,486 | 9/1969 | Germany | 297/16 |

*Primary Examiner*—Roy D. Frazier
*Assistant Examiner*—Peter A. Aschenbrenner

[57] ABSTRACT

A spider socket connector is fixed at one end of a rod of which the other end is fixed to a foot in which a single rear T support is pivoted and settable at several different inclinations. The setting is releasable by virtue of a slip joint, by simply pulling up on the T support. The front legs and the front seat strut bars fitting into the spider form an X concave to the front so as to allow convenient leg room. A seat fabric is suspended between the T support and outwardly extending brackets fitted in the ends of the strut bars, these brackets also serving as handles. The various elongated members can be packed parallel without completely detaching them.

8 Claims, 10 Drawing Figures

DECK CHAIR

This invention relates to a deck-chair of the kind having a foldable frame which when in use rests on a ground surface at three points and flexible sheet material formed, for example, from fabric arranged to be supported by the frame so as to provide a back or seat surface, the frame being settable at various angles of inclination, respectively, for sitting up and for reclining.

An object of the invention is to provide a deck-chair of the above kind which can be manufactured simply and inexpensively, which is comfortable in use and which can be folded for storage in a narrow space so that it can be accommodated for example in a relatively small portable bag.

According to the invention, therefore, there is provided a deck-chair of the kind having a foldable frame which in use rests on a ground surface at three locations and flexible sheet material formed for example from fabric arranged to be supported by the frame so as to provide a back or seat surface, characterized in that the frame has two front supporting legs detachably insertable in a connector arranged to be located above the ground surface, two strut bars detachably insertable in the connector so as to extend inclined upwards for cooperation with the sheet material through bent arm members in the strut bars fitting into corner pockets of the sheet material member, and so that the front supporting legs and the bars together with the connector form an off-plane X-shape, a connecting rod between the connector and a rear ground engaging foot which is rigidly connected to the connector and to the foot, a longitudinally adjustable supporting rod fixed to the foot for cooperation with the sheet material, and a catch device on the foot for adjusting the inclination of the supporting rod, which is releasable by an upward pull on the supporting rod by virtue of a slipjoint at its pivot.

With this arrangement, it is possible to provide a deck-chair which can be manufactured inexpensively and simply. In addition, it may be formed so that when not in use, it takes up very little space and can be folded into a small space. In addition, it may be formed so that different inclinations can be selected so that it can be used selectively for sitting or for reclining.

The invention will now be described further by way of illustrative examples, with reference to the accompanying drawings, in which.

Figure 1:
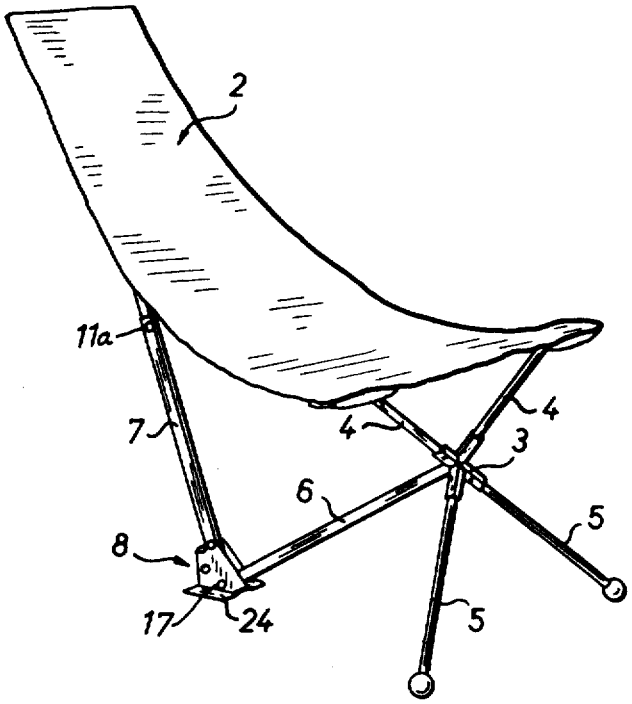
FIG. 1 is a perspective view of one form of a deck-chair.
Figure 9:
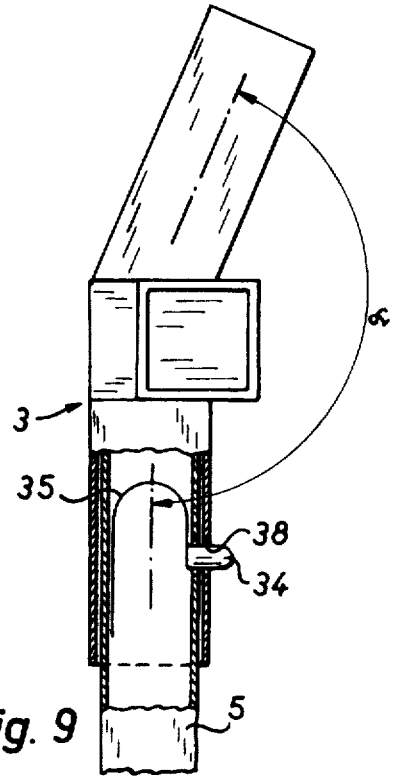
FIG. 9 is a view with partial section of the connector of the deck-chair with supporting legs inserted.
Figure 2:
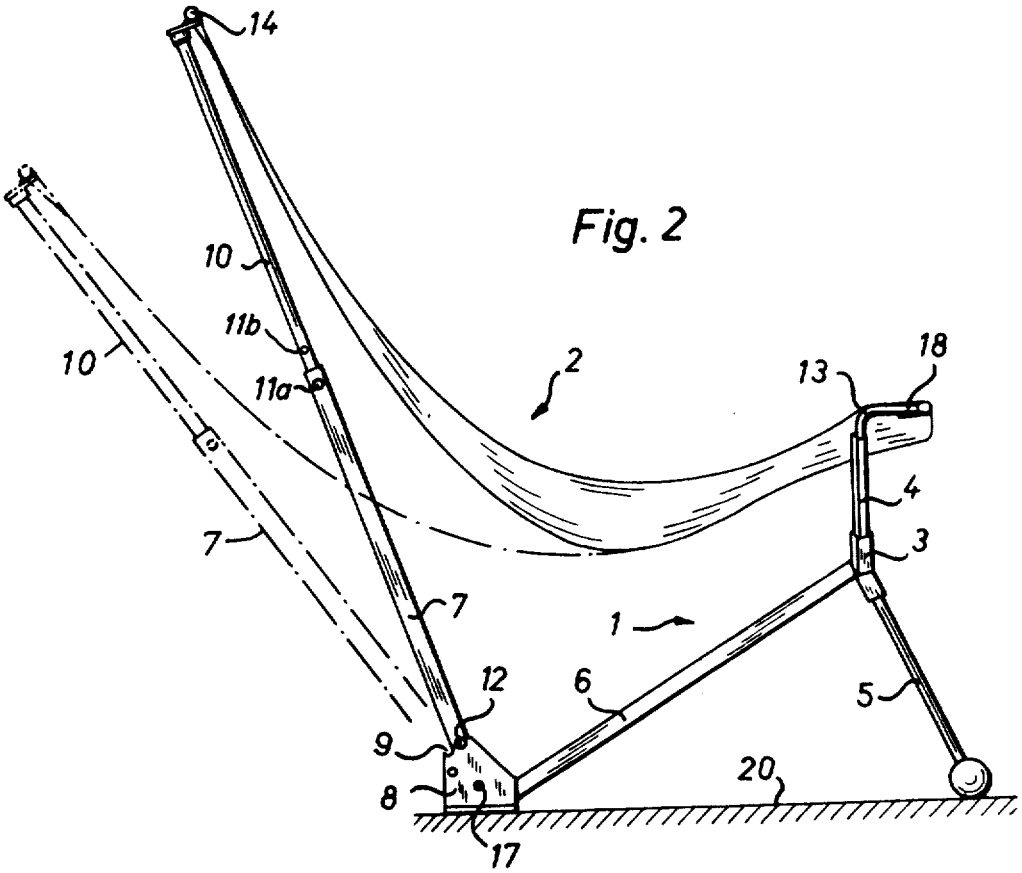
FIG. 2 is a side view of the deck-chair.
Figure 5:
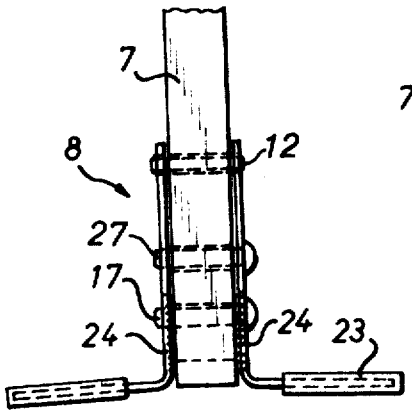
FIG. 5 is a front view of the rear foot of the deck-chair.
Figure 3:
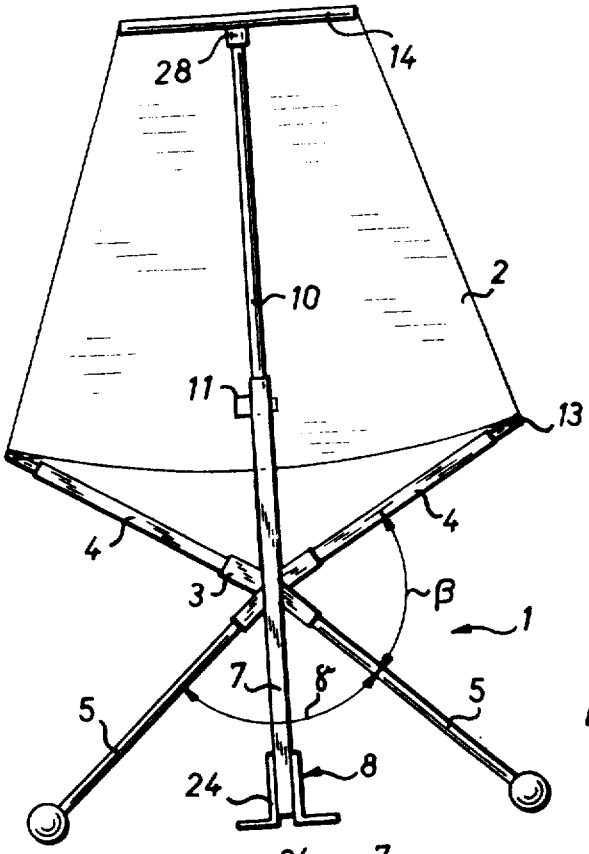
FIG. 3 is a view of the deck-chair from the rear.
Figure 8:
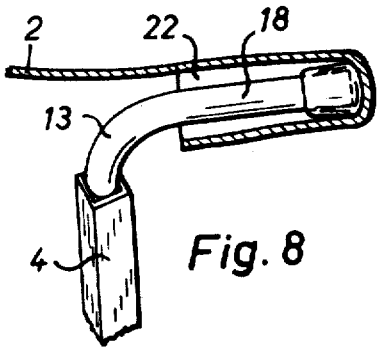
FIG. 8 is a detail view showing the fixing of the fabric cover on one of the bars of the deck-chair.

The deck-chair has a foldable frame 1 and a web covering 2, preferably of woven fabric, as shown in FIGS. 1, 2 and 3. The frame 1 comprises two front supporting legs 5 made of square tubes which in the assembled frame form an angle $\gamma$ of about 95° with one another (see FIG. 3). These two supporting legs are pushed detachably into a tubular spider connector 3 disposed above the ground 20. In two other arms of the spider connector 3 are inserted two front strut bars 4 projecting upwards which, likewise, are inserted detachably in the spider 3. The angle $\beta$ between one strut bar 4 and a supporting front leg 5 amounts to about 85°. Thus, the supporting front legs 5 and the bars 4 form together with the connector 3, a not quite planar X-shape. On the upper end of each strut bar 4, there is fixed an angle piece 13 which penetrates into the inside of the strut bar 4. The bar 4 has the form of a square tube, as can be seen from FIG. 8. The angle piece 13 has a horizontal part directed forwards, which serves to engage in a pocket 22 of the fabric covering 2 opening to the rear. These horizontal parts 18 of the two angle pieces 13 at the same time form a handle which can be taken hold of when getting up or sitting down. As shown in FIG. 9, the axes of the socket arms of the spider 3 lie approximately on the surface of a cone with a large (obtuse) cone angle $\alpha$. Thereby, it is achieved that when sitting, a satisfactory leg freedom results.

Figure 6:
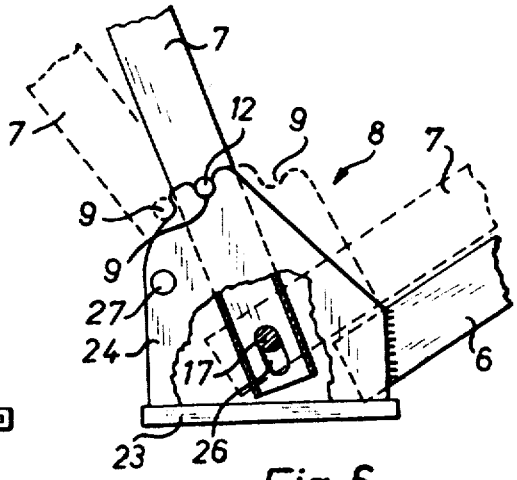
FIG. 6 is a side view of the foot.

Between the spider connector 3 and a foot 8 lying on the ground 20, there is located an inclined connecting rod 6 made of square tubing. The connecting rod 6 is rigidly connected to the foot and welded to the spider 3. The foot has two angle pieces 24 between which on the one hand, there is disposed the connecting rod 6 and, on the other hand, a supporting rod 7. This supporting rod 7 is held pivotably in the foot 8 and can be locked in different positions of inclination, as is indicated in FIGS. 2 and 6 by solid broken lines respectively. A pin 12 projecting on both sides beyond the supporting rod 7 may engage in two or three different catch recesses 9 of the foot 8. In the supporting rod 7, there is a longitudinal slot 26 which is engaged by a pin 17 held in the angle pieces 24, as can be seen from FIG. 6. The angle pieces 24 together support the foot 8 at the rearmost of the three support locations of the chair. When the supporting rod 7 is drawn upwards, the pin 12 comes out of the catch recess 9 and can after the adjustment of the inclination be pushed into another catch recess. The supporting rod 7, upon loading of the fabric covering 2 by a person using the deck-chair, is pressed downwards so that the pin 12 is held securely in the catch recess 9. A bolt 27 limits the pivoting movements of the supporting rod 7 to the rear. The distance between the pin 12 and the longitudinal slot 26 amounts at least to the thickness of the tube (not merely that of the tube wall), so that the forces on the bolt 17 and on the pins 12 and 17 respectively occurring upon loading, are not too great.

Figure 7:
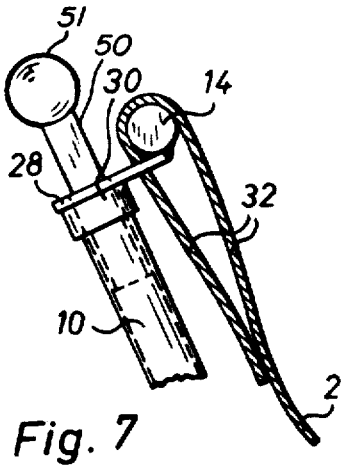
FIG. 7 shows a detail of the suspension of the fabric cover on the upper end of the supporting rod of the deck-chair.

The supporting rod 7 is in two parts and contains a telescopic extensible non-rotatable draw-out rod 10, which, with the aid of a locking pin controlled by the spring knob 11, which pin engages in a bore 11*a*, can be secured in a desired draw-out position. On the upper end of this draw-out rod 10 is located a cross rod 14 which, by means of a connecting piece 28, is inserted fixedly in the upper end of the draw-out rod 10. This cross rod 14 engages in a loop 32 of the fabric covering 2, as can be seen from FIG. 7. The fabric covering 2 is, thus, held on the one hand on the cross rod 14 and, on the other hand, on the two angle pieces 13 and is so cut that in the seating area a trough is formed so that a comfortable seating or reclining possibility results.

The connecting piece 28 is provided with a square opening 30 in which a sun-shade holder is inserted which on its upper end is provided with a ball for holding a parasol while permitting pivotable movement thereof on all sides. The ball could, however, also be fixed on the connecting piece 28.

As can be seen from FIG. 9, the detachable locking of the supporting legs 5, as well as also those of the bars 4 in the connector 3, is effected by means of a spring pin 34 which is connected to a leaf spring 35 in the inside of the tube. The spring pin 34 passes through a bore 38 in the supporting legs 5 and bar 4, respectively, and in the connector 3.

Between the supporting rod 7 and the draw-out rod 10 there is, likewise, provided a detachable catch device whereby on the supporting rod 7 there is a spring-pressed operating knob 11, which engages in axially coinciding bores in the supporting rod 7 and in the draw-out rod 10. In the draw-out rod 10, there are several bores 11*a*, 11*b* etc., spaced apart from one another, so that it can be fixed in different drawout positions, whereby also the sag of the fabric covering may be varied.

Figure 10:
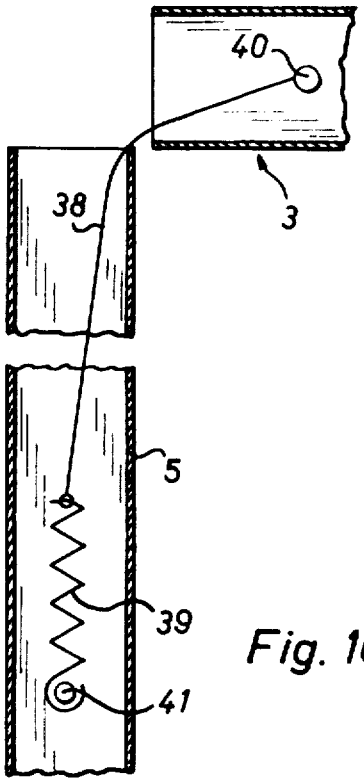
FIG. 10 is a sectional view of a modification.

As shown in FIG. 10, the two supporting legs 5 may be connected, so that they do not become lost and cannot be exchanged, so the spider connector 3 by means of a flexible wire cord 38. Inside each leg 5, there is a traction spring 39 which is tensioned when the legs 5 are drawn out of the connector 3 and turned down. The wire cord 38 is held in the connector 3 by a cross pin 40. The traction spring 39 is suspended in a pin 41 which passes through the supporting leg 5. Thus, the legs 5 can be placed in a space-saving manner approximately parallel to the connecting rod 6. There is a similar arrangement with the bars 4 which, likewise, are provided with a resilient wire cord and thereby remain connected so as not to be lost to the connector 3.

Figure 4:
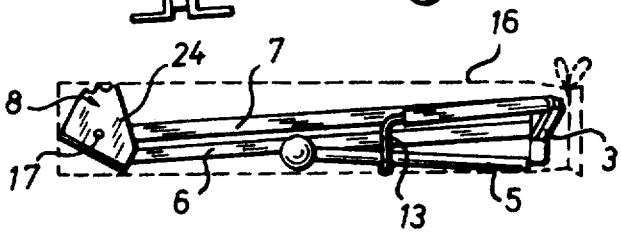
FIG. 4 is a view of the deck-chair in the folded position.

The draw-out rod 10 may be almost completely sunk into the inside of the supporting rod 7, so that the supporting rod 7, together with the draw-out rod 10, is not longer than the connecting rod 6. The frame 1 may thereby be placed together in a space-saving position, so that it can be accommodated comfortably in a portable oblong bag 10, as indicated in FIG. 4. The fabric covering 2, removable from the frame 1, can thus be wound around the folded frame 1.

I claim:

1. A folding deck chair of the kind which when in use rests on a ground surface at essentially three locations, comprising, in combination:

a web of flexible sheet material for providing a combined back and seat surface, having a loop in its normally upper and back end portion for insertion of a cross rod therein for supporting of the upper end of the web and having corner pockets in its normally front and lower end portion for receiving front supports, and a foldable frame comprising a spider connector, a connecting rod rigidly connected to said spider connector, a rear ground-engaging foot rigidly connected to said connecting rod and thereby spaced from said spider connector, said foot having, for mounting a rear support rod, a horizontal pivot and a portion spaced from said pivot provided with catch features, a telescopically adjustable rear support rod pivotably connected to said foot by means of a slip joint cooperating with said pivot of said foot and having catch features cooperating with the catch features of said foot and with said slip joint for setting the inclination of said rear support rod at one of a plurality of selectable settings, said respective catch features being of a configuration allowing their release from each other by a pull on said support rod away from said foot actuating said slip joint, the pivotable connection of said rear support rod to said foot being such that said rear support rod can be folded in the folded state of the deck chair, approximately parallel to said connecting rod, the length of said rear support rod, in its telescopically shortest state, corresponding approximately to that of said connecting rod, a cross rod detachably insertable in the upper end of said rear support rod in a manner fixed against rotation about the axis of said rear support rod for insertion into said loop of said web for support of said web, two front support legs disengageably insertable in said spider connector for supporting said connector and thereby the front of the deck chair above the ground, and two front strut bars disengageably insertable in said spider connector in respective positions normally extending obliquely upwards from said connector and each having an arm bent at an angle set in its normally upper end for penetrating into one of said corner pockets of said web for support thereof and for availability of its more horizontal part for service as a handle to assist a seated person in getting up, said spider connector being of such a configuration that in the unfolded and assembled state of the deck chair the connector, front support legs and strut bars form an off-plane X-shape.

2. A deck-chair according to claim 1, in which the front support legs and the strut bars consist of square tubes, in which also the geometric tube axes in the region of the spider connector lie at least approximately on the surface of an imaginary shallow obtuse cone, and in which the angle between the strut bars is greater than that between the legs.

3. A deck-chair according to claim 1, in which on the upper end of the rear support rod there are provided means for the detachable fixing of a parasol.

4. A deck-chair according to claim 3, in which in the upper end of the supporting rod there is detachably inserted a square rod which has on its upper end a ball for the pivotally adjustable fixation of a parasol.

5. A deck-chair according to claim 1, in which the supporting legs and the strut bars, in the area of the ends inserted into the spider connector, are each provided with a spring-pressed pin for securing against withdrawal from said connector.

6. A deck-chair according to claim 1 in which each of the supporting legs and of the strut bars is retained in connection with the spider connector, even when disengaged therefrom, by wire traction means including a tension spring and having one end disposed inside the spider connector.

7. A deck-chair according to claim 1, in which the foot contains two angle pieces which are rigidly connected to the connecting rod and the respective upper edges of the angle pieces contain at least two catch recesses in which a cross pin inserted in the rear support rod engages selectively for varying the inclination of the supporting rod.

8. A deck-chair according to claim 7, in which the said rear support rod has a longitudinal slot where it is pivoted on said foot for providing said slip joint, which slot is passed through by a bolt located rigidly in said angle pieces of the foot, and said cross pin inserted in said support rod for engaging in the catch recesses is located on said support rod at a position spaced apart from the longitudinal slot by a distance not less than the maximum cross-sectional dimension of the support rod.

* * * * *